United States Patent [19]

Bredeweg et al.

[11] Patent Number: 4,871,098

[45] Date of Patent: Oct. 3, 1989

[54] HOOK SOCKET FOR GANGING HANGERS

[75] Inventors: Robert A. Bredeweg; Russell O. Blanchard, both of Zeeland, Mich.

[73] Assignee: Batts, Inc., Zeeland, Mich.

[21] Appl. No.: 197,598

[22] Filed: May 23, 1988

[51] Int. Cl.[4] ..... A47G 25/18

[52] U.S. Cl. ..... 223/85; 223/92; 211/113; D6/318

[58] Field of Search ..... 223/85, 87, 92, 93; 211/113; D6/315, 318, 319, 328; 224/42.45 A, 42.46 A

[56] References Cited

U.S. PATENT DOCUMENTS

| | | | |
|---|---|---|---|
| D. 140,337 | 2/1945 | Hill | D6/319 |
| D. 234,243 | 2/1975 | Lindemann | D6/328 |
| D. 275,539 | 9/1984 | Mainetti | D6/319 |
| 2,498,400 | 2/1950 | Du Lude | 223/88 |
| 3,270,892 | 9/1966 | Dennis et al. | 211/113 |
| 4,007,861 | 2/1977 | Duester et al. | D6/328 X |
| 4,416,401 | 11/1983 | King | 223/92 X |
| 4,638,930 | 1/1987 | Blanchard | 223/93 X |
| 4,653,678 | 3/1987 | Blanchard et al. | 223/92 X |

FOREIGN PATENT DOCUMENTS

| | | | |
|---|---|---|---|
| 739180 | 10/1932 | France | 223/87 |
| 2559662 | 8/1985 | France | 223/85 |

*Primary Examiner*—Robert R. Mackey

*Attorney, Agent, or Firm*—Price, Heneveld, Cooper, DeWitt & Litton

[57] ABSTRACT

A garment hanger having a molded plastic body supported from above by a hook at its center has a dependent loop vertically aligned with the hook. The legs forming the loop are joined at their lower ends and are offset from each other in a normal to the face of the hanger whereby the hook of a second hanger can be passed through the loop and support the second hanger while confined between and parallel to the front and back faces of the hanger body supporting it.

7 Claims, 1 Drawing Sheet

HOOK SOCKET FOR GANGING HANGERS

FIELD OF THE INVENTION

A hanger construction is disclosed by which a second hanger can be supported beneath another hanger with the hook of the second hanger being aligned with and confined between the vertical planes of the front and back faces of the hanger above.

BACKGROUND OF THE INVENTION

In the display and merchandising of garments, it is, with certain garments, desirable to simultaneously display two garments together as a coordinated group. On other occasions it may be desirable to display several garments simultaneous such as to display like garments of different colors. In cases of this type, it is desirable to support each of the garments on a separate hanger and then to arrange the hangers and the garments vertically in a tier with all of the hangers for such an arrangement being supported from the top hanger. Various arrangements for doing this have been developed in the past as for example that disclosed in U.S. Pat. No. 4,653,678, entitled GANGING HOOK FOR GARMENT HANGERS, issued March 31, 1987, to R. O. Blanchard et al. These constructions have worked well but have certain structural and functional features which limit their use. If the hook of the lower hanger is not rotatable with respect to the body, the lower hanger must always be parallel to the upper hanger. At times, this is inconvenient when connecting or disconnecting the hangers Also, at times, it may be inconvenient when the lower hanger is loaded or unloaded while supported on the upper hanger. There are also display circumstances when it would be desirable to arrange the hangers at right angles to each other. Another aspect of hangers of this type is the desirability of so connecting the hangers that they will not become disconnected unless it results from an intentional separation by an operator. This invention permits the hook of the lower hanger to be passed through an opening in a loop which is just large enough for the purpose and thus restrictive of disconnection unless it is the result of an intentional act.

BRIEF DESCRIPTION OF THE INVENTION

A loop is provided which is integral with and depends beneath the body of the hanger. The legs which form the loop are joined at their lower ends and are spaced apart in a direction normal to the plane of the hanger's body. Thus, the opening into which the hook of the lower hanger is seated permits the hook to be positioned parallel to the body of the hanger above even though it passes through the loop and, while being connected and disconnected, may be substantially normal to the body of the hanger above.

DESCRIPTION OF THE PREFERRED EMBODIMENT

Figure 1:
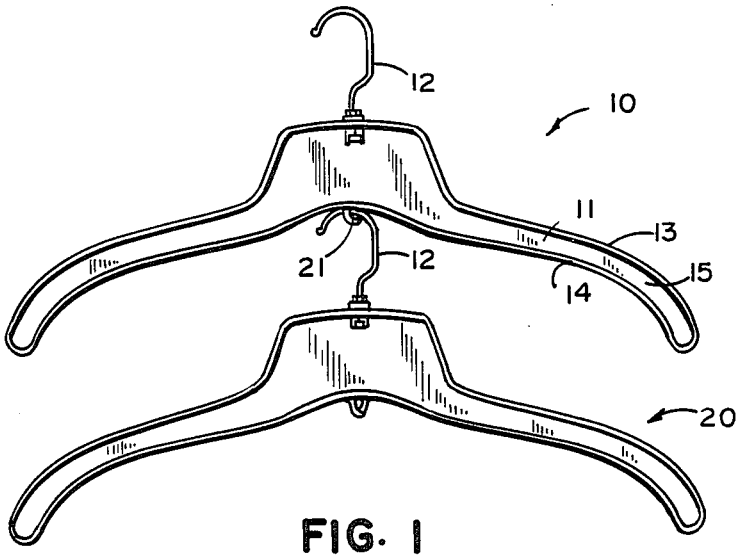
FIG. 1 is a front elevation view of a pair of hangers ganged together by means of this invention.
Figure 2:
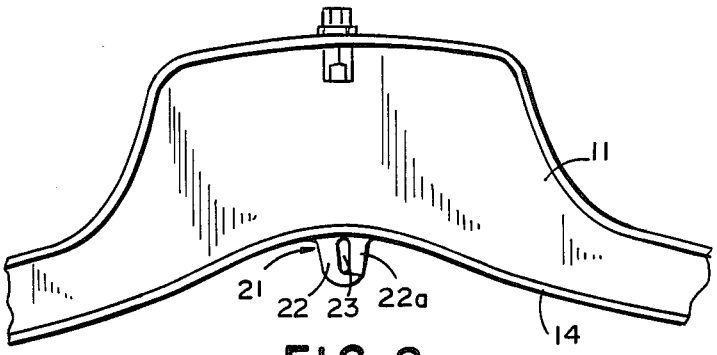
FIG. 2 is a fragmentary, enlarged, front view of a hanger incorporating this invention.

The numeral 10 refers to a hanger incorporating this invention and having a one-piece, molded plastic body 11 supported at the center by an upstanding wire hook 12. The body 11 is of a construction which simulates an I-beam, that is, having an upper flange 13 and a lower flange 14 connected by a vertical web 15.

Figure 7:
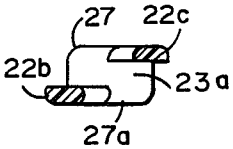
FIG. 7 is a fragmentary sectional view taken along the plane VII—VII of FIG. 6.
Figure 4:
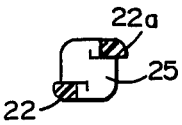
FIG. 4 is a fragmentary sectional view taken along the plane IV—IV of FIG. 3.
Figure 5:
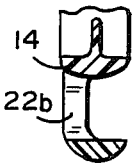
FIG. 5 is a sectional view taken along the plane V—V of FIG. 3.
Figure 9:
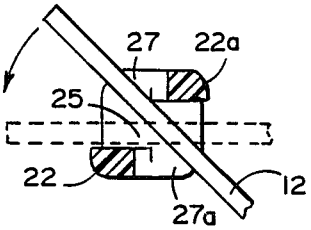
FIG. 9 is an enlargement of FIG. 4 illustrating mounting of the lower hanger.

As illustrated in FIG. 1, a secondary hanger 20 is suspended from and beneath the upper hanger 10 by means of a loop 21 depending beneath the upper hanger. The loop is molded integral with the body of the hanger. The loop is formed by a pair of legs 22 and **22*a* which are integrally joined at their lower ends. The legs form a vertically elongated hook opening 23 between them which, when viewed from a position aligned with an axis centered in the loop and normal to the plane of the web 15, is just wide enough to pass a wire hook of another hanger through it. However, the legs are offset with respect to each other with one being flush with one edge of the flange 14 and the other flush with the opposite edge thereof. No portion of either of the legs 22 and 22*a* projects beyond the front or rear edges of the lower flange 14. This creates a passage 25 between the legs which is substantially wider than the thickness of a hook 12 with the axis of the passage being inclined at a substantial angle such as 30°–45° to the axis of the body 11 (FIGS. 4, 7 and 9). This arrangement allows the secondary hanger 20** to be supported in any position between alignment with and perpendicular to the axis of the main hanger.

The width of the loop, as viewed normal to the face of the primary hanger, could be narrower than the thickness of the secondary hanger's hook requiring the secondary hanger hook to be inserted at an angle and then rotated into alignment with the primary hanger.

The inside faces of the legs **22*a* and *b* are spaced apart a distance to receive the hook of the secondary hanger between them when it is aligned with the body of the primary hanger. The bottom of the passage 23*b* thus formed is created by a portion which is integral with and bridges the distance between the legs and their extended foot portions 27 and 27*a* which extend past the other leg (FIG. 9**). The surface of this passage is convexly arched to provide proper bearing for the hook of the secondary hanger when it is seated on it.

Because the hook of the secondary hanger is passed through hook opening 23, it is positively held against unwanted separation such as may occur during transportation or handling. Further, since the construction creates a closed loop supported by both legs, it has the necessary strength to support heavy loads such as may occur if several hangers are suspended in a tier.

Figure 6:
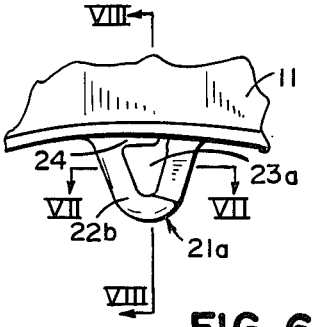
FIG. 6 is a fragmentary, front view similar to FIG. 3 illustrating a modification of the invention.
Figure 3:
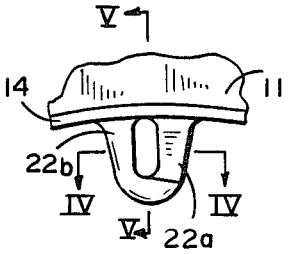
FIG. 3 is a fragmentary enlarged front view of the secondary hanger support loop of this invention.
Figure 8:
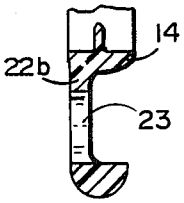
FIG. 8 is a sectional view taken along the plane VIII—VIII of FIG. 6.

FIGS. 6–8 illustrate a somewhat different construction for the loop **21*a* which is generally V-shaped due to the divergence of the legs 22*b* and 22*c* providing a wider opening 23*a* at the top. Also, the leg 22*b* has a portion 24 extending along the bottom surface of the flange. The portion 24 is non-functional so far as the operation of the loop is concerned. It serves solely to provide an area for gating the mold cavity during molding. The shape of the loop 21***a* makes it somewhat easier to pass the hook through the loop both when mounting and when removing. This can be a substantial advantage to personnel when they are very busy. While it does somewhat reduce the ability of the loop to retain the hook of the secondary hanger under adverse conditions, the retention characteristics are sufficient for all normal usages.

The entire hanger body including the loop can be molded as a one-piece unit from any of a number of synthetic resins including polypropylene, polyethylene, nylon or styrene. Because of its design, the hanger can be molded without any slides or the like to permit removal from the mold.

Having described a preferred embodiment and a modification thereof, it will be recognized that other modifications can be made without departure from the principle of the invention Such modifications are to be considered as included in the hereinafter appended claims unless these claims by their language expressly state otherwise.

We claim:

1. A molded plastic garment hanger having means for supporting beneath it a wire hook equipped second hanger, said hanger having generally parallel front and back faces and a lengthwise, elongated body therebetween, a second hanger engaging means depending from said body and centered between both the ends and the faces of said body, said means comprising: a closed loop formed by a pair of legs, said legs being spaced apart lengthwise of said hanger and integrally joined at their lower ends to provide a hook receiving opening of a width lengthwise of said body sufficient to permit the wire hook of a second hanger to be passed therethrough; the joinder of said lower ends of said legs including a connecting member formed by foot portions extending generally horizontally from the lower ends of said legs in opposite directions and in a fore and aft direction being joined together by an integral bridging portion therebetween, with part of said foot portions forming extensions of the bridging portion and with said bridging portion providing support for the hook of the second hanger, said legs being spaced apart normal to said faces of said body a distance sufficient to permit the wire hook of a second hanger to be seated between said legs while said hook is aligned with and all of said hook and the body of the second hanger are positioned between the front and back faces of said body.

2. The garment hanger described in claim 1 wherein each of said foot portions extends past the other of said legs at least to the edge thereof remote from the leg from which it projects to provide an elongated seat for the hook of the second hanger which permits the second hanger to be initially mounted by insertion of its hook in a direction either parallel to the hanger's body or in a direction inclined thereto in a fore and aft direction.

3. The garment hanger described in claim 1 wherein the ends of the connecting member extend generally normal to said front and back faces to bias the hook of the second hanger to seat itself parallel to the faces of said body and so support the body of the second hanger.

4. The garment hanger described in claim 3 wherein said connecting member forms a hook seat between said legs extending lengthwise of said body, said hook seat being inclined downwardly at a minor angle in both directions from the midpoint between its ends to accommodate the curvature of the hook of the second hanger and bias it to center itself lengthwise of the hanger and to align itself parallel to and beneath the hanger body.

5. The garment hanger described in claim 1 wherein said legs are parallel and spaced apart a distance only sufficient to permit the hook of the second hanger to be passed between them in a direction normal to said faces of said body.

6. The garment hanger described in claim 1 wherein said legs are parallel and spaced apart lengthwise of said body a distance less than the thickness of the hook of the second hanger whereby said hook has to be passed between said legs at an angle less than 90° to the faces of said body and then rotated to a position aligned with said body.

7. The garment hanger described in claim 1 wherein said legs are inclined and converge downwardly toward each other.

* * * * *